United States Patent [19]

Tobin et al.

[11] 4,176,348

[45] Nov. 27, 1979

[54] ELECTRONIC SECURITY DEVICE

[75] Inventors: Joseph J. Tobin, San Marcos; David B. Robinson, Carlsbad; Robert L. Peay, Encinitas; Jerry R. Powell, Vista; Leslie W. Gay, Escondido, all of Calif.

[73] Assignee: Coded Communications, Carlsbad, Calif.

[21] Appl. No.: 891,505

[22] Filed: Mar. 30, 1978

[51] Int. Cl.[2] ..... G08B 13/26

[52] U.S. Cl. ..... 340/562; 331/65; 340/514

[58] Field of Search ..... 340/562, 514; 331/65; 333/70 S, 185

[56] References Cited

U.S. PATENT DOCUMENTS

| | | | |
|---|---|---|---|
| 3,761,912 | 9/1973 | Stettner et al. | 340/566 |
| 3,784,848 | 1/1974 | Hamilton | 331/65 |
| 4,083,022 | 4/1978 | Nijman | 333/70 S |
| 4,091,371 | 5/1978 | Mason, Jr. et al. | 340/562 |

*Primary Examiner*—Glen R. Swann, III
*Attorney, Agent, or Firm*—Brown & Martin

[57] ABSTRACT

An electronic security device includes an insulated loop shaped antenna which capacitively couples to any objects which intrude into a zone surrounding the antenna. The loop shape allows the antenna to be placed onto a doorknob of the room to be secured, and the insulation prevents electrical contact-bounce between the antenna and the doorknob. A detector circuit connects to the antennna and generates output signals indicating the amount of capacitive coupling. An alarm circuit connects to the detector circuit and sounds an audible alarm for a predetermined time interval when the coupling as indicated by the output signals implies that an object has intruded into the zone. A test circuit connects to the alarm circuit for temporarily decreasing the time interval of the alarm in response to a manually activated switch to allow the security device to be tested prior to being fully activated.

14 Claims, 5 Drawing Figures

ELECTRONIC SECURITY DEVICE

BACKGROUND OF THE INVENTION

The disclosed invention relates to electronic devices for detecting the presence or absence of objects, and more particularly to electronic security devices for detecting the presence of intruders. In the prior art, a wide variety of security devices exist. Perhaps the most commonly used security device is a conventional lock and key. However, the lock and key is unsatisfactory in situations when one desires security where pass keys or master keys exist. This is a common situation in a hotel or motel for example. Many locks are also unsatisfactory as a security device in that they can easily be picked by burglars or vandals.

One prior art security device which overcomes these deficiencies is an acoustic detector. In operation, the acoustic detector is placed in a room to be secured. There it generates sound waves at a frequency above the audio range. These waves are reflected off objects inside the room and received by the detector to determine if any frequency shift has occurred. That is, these detectors operate on the Doppler effect. A problem with these devices however is that they only operate to detect movement inside the room which is to be secured. Accordingly, an alarm is sounded only after a burglar or vandal has actually entered the secured area.

Another prior art security device consists of an electronic alarm having a mechanically operated trigger. Typically, this device is rigidly attached to the inside of a door; and a chain connects a switch on the device to a rigid anchor point on the wall along side the door. In operation, as the door is opened, the chain tightens and throws the switch thereby activating the alarm. A problem with this device, however, is that while it detects burglars before they enter the protected area, detection still does not occur until the door is actually opened and entrance is imminent. Also, these devices are not portable; but require a permanent fixture to the door and wall inside the protected area. Thus, they are not suitable for use by travelers in hotel or motel rooms.

To overcome all of the above described problems, it is desirable to have an all electronic security device which cannot be circumvented by passkeys, cannot be picked by vandals, detects vandals before they enter the secured area, and is portable for use by travelers in motel rooms. Further, the device must be highly reliable. Specifically, the device must be immune to giving off false alarms. For example, the device's alarm must not be triggered by common everyday occurrances; such as vibrations, temperature changes, RF noise, and humidity changes. The disclosed invention meets all of the above requirements. Basically, its operation is based on electromagnetic capacitive coupling principles. Only one other known prior art attempt was made to build a security device based on capacitive coupling principles; and that work never went beyond the experimental stage, the results were never published, and no workable device resulted therefrom.

Therefore, it is one object of the invention to provide an improved security device.

Another object of the invention is to provide a security device which detects burglars, vandals, etc., before they actually enter the secured area.

Another object of the invention is to provide a security device which is portable and thereby suitable for use by travelers within motel and hotel rooms.

Another object of the invention is to provide a security device which operates without mechanical or acoustic triggering.

Another object of the invention is to provide a highly reliable security device which operates on electromagnetic capacitive coupling principles.

SUMMARY OF THE INVENTION

These and other objects are accomplished in accordance with the invention by a first circuit which capacitively couples to objects lying within a zone surrounding the first circuit. In one preferred embodiment, the first circuit is a loop shaped antenna. This loop, in operation, is placed onto a door knob inside the protected area. The zone then includes the corresponding other door knob outside of the protected area. A second circuit connects to the first circuit and generates output signals indicating the amount of the capacitive coupling between the first circuit and any objects lying within the zone. In one preferred embodiment, the second circuit is a variable frequency oscillator which generates output signals having frequencies indicating the amount of capacitive coupling. A third circuit connects to the second circuit and receives the output signals. In response thereto, the third circuit takes predetermined action when the output signals indicate that an object has intruded into or is moving within the zone. In one preferred embodiment, the predetermined action includes the sounding of an audible alarm. Also included is a fourth circuit connected to the third circuit. The fourth circuit temporarily shortens the length of the audible alarm signals for test purposes in response to a manually activated switch.

BRIEF DESCRIPTION OF THE DRAWINGS

The novel features believed characteristic of the invention are set forth in the appended claims. The invention itself, however, as well as other features and advantages thereof, will best be understood by reference to the following detailed description of particular embodiments when read in conjunction with the accompanying drawings, wherein:

DETAILED DESCRIPTION

Figure 1:
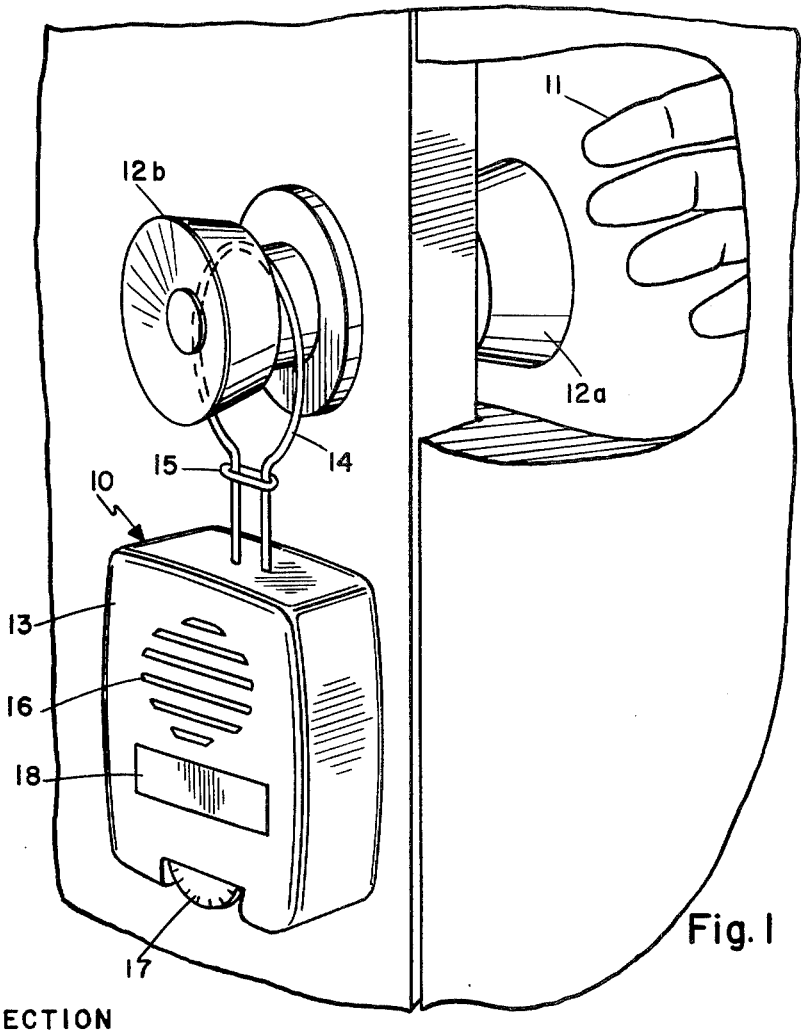
FIG. 1 is a pictorial drawing of a security device constructed according to the invention in a typical operating environment.

Referring now to FIG. 1, there is illustrated a pictorial diagram of a security device 10 constructed according to the invention in a typical operating environment. In this environment, security device 10 detects the hands 11 of burglars or vandals as they approach a door knob 12*a* outside of the secured room. Basically, device 10 is comprised of a plastic case 13 in which is contained most of the circuits that operate to detect the burglars. Protruding from case 13 is an antenna 14. Preferably, antenna 14 is comprised of a flexible loop-shaped wire having a non-conductive coating such as plastic. A slip loop 15, which suitably is comprised of plastic, fits around antenna 14. To install device 10, slip loop 15 is moved toward case 13, antenna 14 is subsequently placed over a door knob 12*b* which is inside of the secured room; and thereafter slip loop 15 is moved toward door knob 12*b* to hold device 13 snugly in place. This is one means whereby the reliability of device 10 is enhanced. That is due to the operation of slip loop 15, any movement of device 10 relative to door knob 12*b* due to vibrations, air current, etc., is practically eliminated. As a result, false alarms which could occur due to capacitance changes between door knob 12*b* and case 13 are substantially eliminated. In an unusually high vibration environment, further reliability is achieved by including on the back of case 13, a sticky material such as a velcro strip or a suction cup. These are pressed against the door on which device 10 is hung to hold the device firmly in place.

When hand 11 is not near door knob 12*a*, the electronics within case 13 generates signals on antenna 14 of a relatively high frequency, such as 2 MHz. At such frequencies, the input capacitance to antenna 14 is dependent upon the presence or absence of objects within a zone of several inches from the antenna. This zone includes a door knob 12*a*. As objects, such as hand 11, approaches door knob 12*a*, the input capacitance of antenna 14 increases. Included within case 13 are circuits connected to antenna 14 for generating output signals indicating the amount of this input capacitance. Also includes in case 13 are circuits connected to receive those output signals and for sounding an audible alarm for approximately one minute through a speaker 16 whenever the output signals imply that an object has intruded into the zone, i.e. that hand 11 has approached door knob 12*a*. These circuits will be described in detail in conjunction with FIGS. 3 and 4. A manually activated switch 17 is provided which couples to the alarm circuit for temporarily decreasing the length of the audible alert signals to approximately one second. This allows an operator of device 10 to initially place the device on door knob 15 without setting off long alert signals and to test the device after he closes the door. The operation of this circuit will be described in detail in conjunction with FIG. 5.

Figure 2:
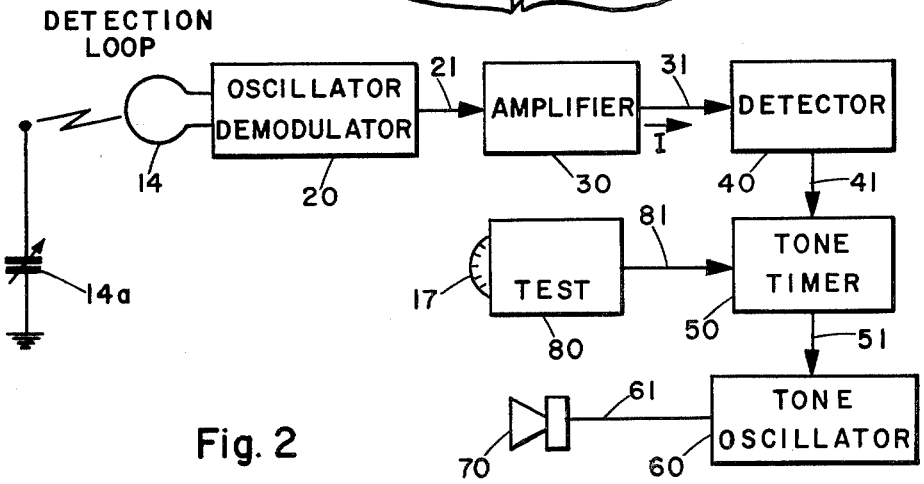
FIG. 2 is a block diagram of the electronics within the device of FIG. 1.

An overview of the electronics within device 10 will now be described in conjunction with the block diagram of FIG. 2. These electronics include an oscillator-demodulator 20 having inputs coupled to antenna 14. Oscillator 20 is a variable frequency oscillator. It generates output signals on a lead 21 whose frequency and time varying DC level indicates the change in amount of capacitive coupling between antenna 14 and objects within the detect zone of the antenna. This coupling is indicated in FIG. 2 as a variable capacitor 14*a*. Capacitor 14*a* increases as objects enter the zone. Lead 21 is AC coupled to the input of a DC amplifier 30. When signals on lead 21 change from a relatively high frequency to a relatively low frequency, amplifier 30 operates to temporarily reverse the direction of current I on an output lead 31. Typically, current I changes direction on lead 31 for approximately several milliseconds. Lead 31 couples to the input of a detector circuit 40. In operation, circuit 40 generates logic level output signals on leads 41 which, by their logical state, indicate the direction of current I. Leads 41 couple to the input of a tone timing circuit 50. Circuit 50 operates to generate a logical signal on a lead 51 having a pulsewidth of a predetermined duration to act as a signal for enabling an alarm circuit. Suitably, the pulsewidth of signals on lead 51 is approximately one minute. Leads 51 couple to a tone oscillator circuit 60; and oscillator circuit 60 has outputs coupled to a speaker 70 via leads 61. Circuit 60 generates signals of an audio frequency (e.g. 800 Hz) on lead 61, and these signals are converted to audible sounds by speaker 70. Also included in the FIG. 2 block diagram is an test circuit 80. Circuit 80 includes switch 17, and has outputs coupled via leads 81 to inputs on tone timer circuit 50. In response to one setting of switch 17, circuit 80 temporarily decreases the pulsewidth of the enabling signals on leads 51. Suitably, the pulsewidths on lead 51 are decreased to last approximately one second, and this temporary condition lasts for approximately 15 seconds.

Figure 3:
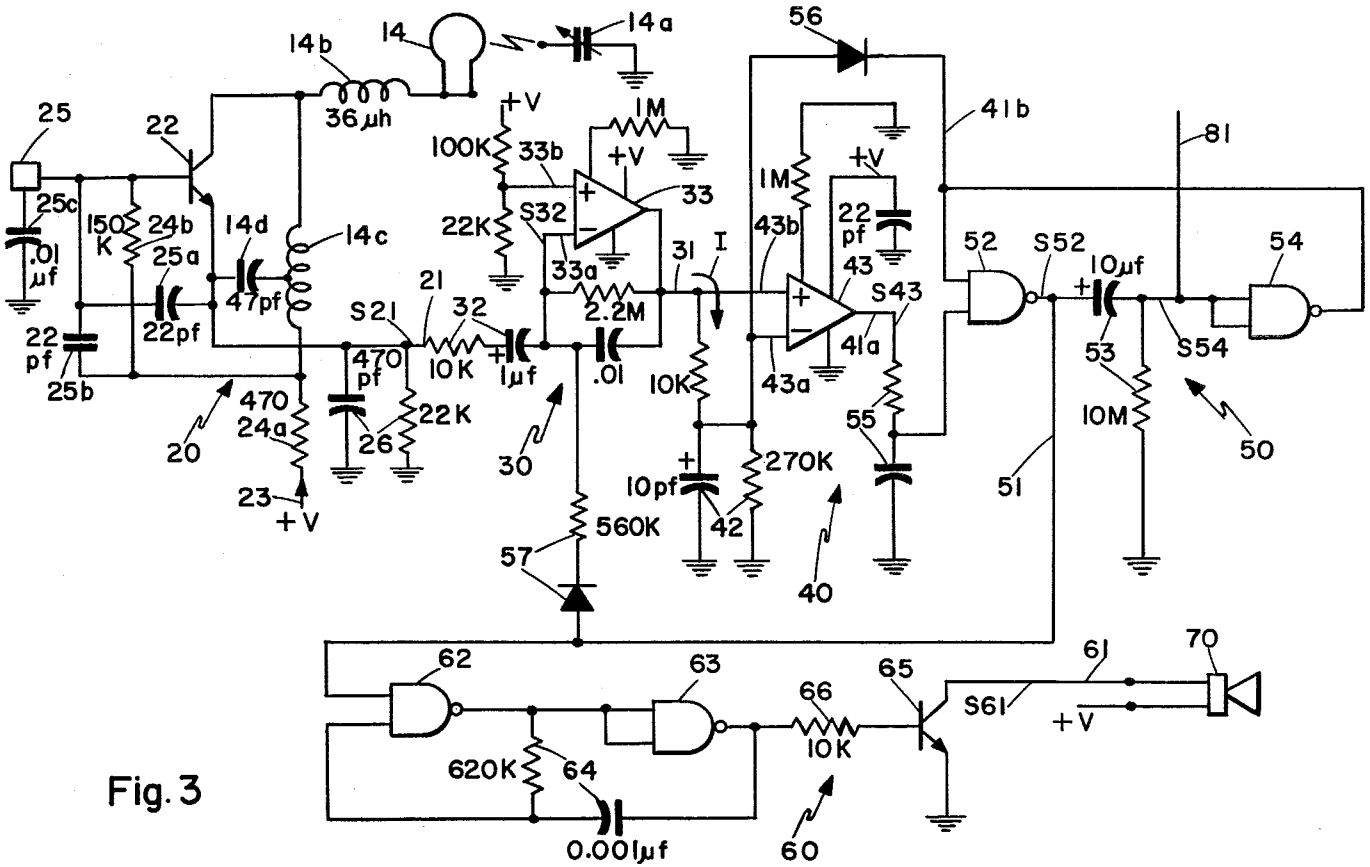
FIG. 3 is a detailed circuit diagram of a majority of the blocks of FIG. 2.
Figure 4:
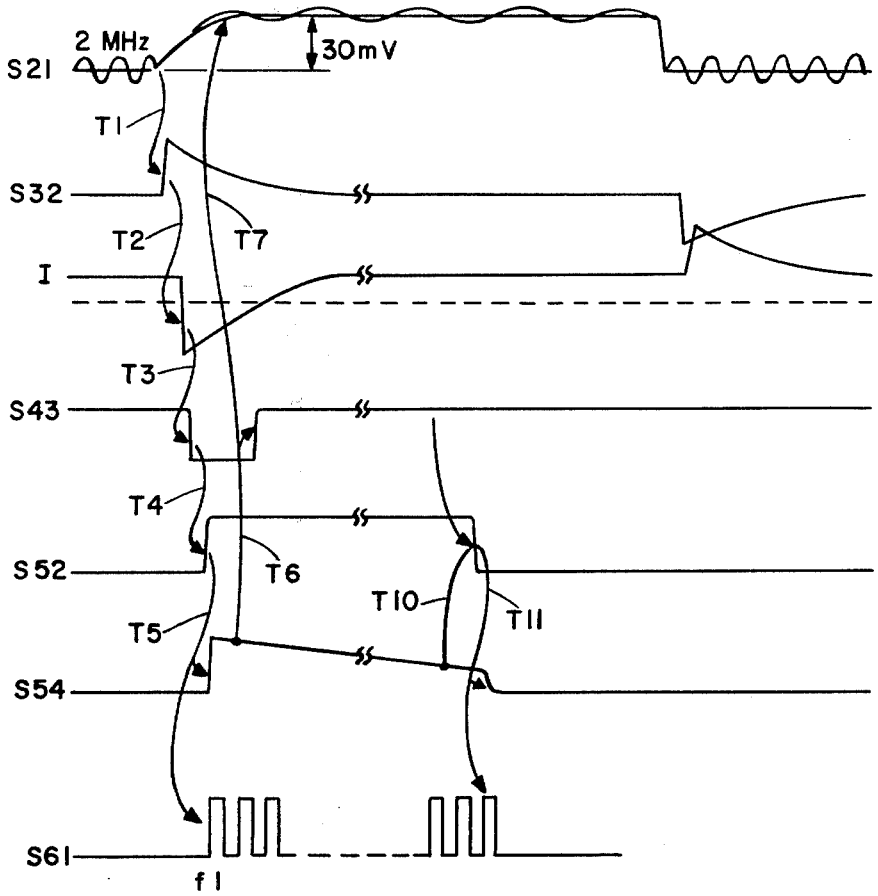
FIG. 4 is a timing diagram of signals of various points within the circuit of FIG. 3.

Details of the circuits comprising most of the above described blocks are illustrated in FIG. 3, and signals of various points therein are illustrated in FIG. 4. Referring now to FIG. 3, oscillator 20 includes a NPN transistor 22 as the active element. Transistor 22 is biased by voltage source 23, resistors 24*a* and 24*b*, and by an RC circuit 26. A tank circuit, which is comprised of antenna 14, variable coupling capacitance 14*a*, inductors 14*b* and 14*c*, and a capacitor 14*d* determines the frequency of oscillation of circuit 20. Specifically, circuit 20 oscillates at approximately 2 MHz with no hands lying within a few inches from antenna 14, and oscillates at a reduced frequency and may even stop oscillating when a hand is within a few inches (e.g. 2 inches) of antenna 14. The presence of a hand adds approximately 15 to 20 picofarads to the tank circuit. And due to this increased capacitive loading, the resonant frequency of circuit 20 is reduced. As a result, output signals on lead 21 are of the reduced frequency, and a corresponding higher DC level.

In order to avoid false alarms, oscillator 20 further includes bypass capacitors 25*a*, 25*b*, 25*c* and a RF ferrite bead 25*d* as illustrated in FIG. 3. These components operate to eliminate false alarms due to radio RF interference and capacitive coupling changes which occur at rates higher than human movement. Such capacitive changes commonly occur for example if rain drops fall near to exterior door knob 12*a*. Preferably, bead 25*d* is placed directly on the ungrounded terminal of capacitor 25*c*. Through much experimentation, it was discovered that this positioning gave the best results substantially better results than those achieved by placing bead 25*d* directly on the base terminal of transistor 22 for example.

Resistor-capacitor components 26 form a low pass filter for the variable frequency signals on lead 21. Therefore the DC voltage level of signals on lead 21 increases in response to lower frequency signals. Typically, the DC voltage level increases by approximately 30 millivolts when a hand intrudes near to door knob 12*a*. This is illustrated in FIG. 4 by a signal S21 which represents the signals on lead 21. Signals S21 is AC coupled through a resistor-capacitor circuit 32 to the input of amplifier 30. This AC coupling produces a signal S32 on an input 33*a* of an operational amplifier 33. Amplifier 33 also has a second input 33*b* connected to receive a voltage of a predetermined DC level. In operation, amplifier 33 generates output voltages of a negative polarity when input 33*a* is more positive than input 33*b*; and generates output signals of a positive polarity when signals to input 33*a* are less positive than those to input 33*b*. Due to the AC coupling of circuit 32, signals to input 33*a* are most positive when signal S21 goes from a relatively low DC level to a relatively high DC level. Under such conditions, signal S32 on input 33 is in the form of a positive voltage spike as illustrated in FIG. 4 at time T1.

The ability of the disclosed device to avoid false alarms is significantly increased by two subtle features of the above described circuit. First, current I will not change direction in response to very slow frequency shifts or accompanying slow DC voltage shifts in signal S21. This is because of the AC coupling supplied by circuit 32. In operation, slow frequency shifts may be caused by a variety of commonly occurring conditions, such as temperature changes or humidity changes. Second, current I will change direction in response to voltage level shifts of approximately 30 mv regardless of the absolute frequencies that produce the level shift. That is, the direction of current I and the operation of the device is not dependent on some narrow band of frequencies. This is important, because absolute frequency dependent circuits must use expensive precision components to maintain the desired frequencies and are subject to failure when the bias voltage source (battery) ages.

In response to the positive voltage spike of signal S32, the output voltage of amplifier 33 changes from a positive polarity to a negative polarity. A lead 31 couples the output of amplifier 33 to an RC low pass filter circuit 42, which forms part of detector 40. Circuit 42 charges via current I on lead 31 when the output of amplifier 33 is positive, and discharges via current I when the output of amplifier 33 is negative. Lead 31 also couples to the inputs 43*a* and 43*b* of a second DC operational amplifier 43. Prior to time T1, signals at input 43*b* are more positive than signals at inputs 43*a*. As a result amplifier 43 generates output signals S43 of a high logic level. Conversely, subsequent to time T1 while circuit 42 discharges, signals at inputs 43*a* are more positive than signals at input 43*b*, and thus the output signals S43 of amplifier 43 go to a low logic level. This sequence is illustrated in FIG. 4 via the signals I and S43 at time T2.

Signal S43 along with the signal on input 43*a* couple to the inputs of tone timing circuit 50. More specifically, these signals couple via leads 41*a* and 41*b* to respective inputs of a logical NAND gate 52. The output of NAND gate 52 couples through a timing circuit 53 to the input of a second NAND gate 54; and the output of NAND gate 54 feeds back to lead 41*b*. Just prior to time T2, the signals on leads 41*a* and 41*b* are both at logical highs, and thus the output of NAND gate 52 is a logical low. Subsequent to time T2, the reverse flow of current I causes signal S43 to go low as indicated at time T3. This low voltage is fed through RC circuit 55 to the input of gate 52. A low logic level at the input of gate 52 forces its output S52 high as indicated at time T4. In response, signal S54 at the input of gate 54 goes to a logical high. However, due to the RC coupling of circuit 53, signal S54 discharges from the high voltage state to a low voltage state. This is indicated at time T5 and T6. The resistor-capacitor values chosen for circuit 53 give rise to a discharge time of approximately 1 minute. Upon the discharge of circuit 53, the input to gate 54 is at a logical low, and thus the output of gate 54 switches to a high. This high voltage level is fed back to gate 52 via lead 41*b*. In response thereto, the output of gate 52 goes to a logical low and circuit 50 is returned to the state it was in before time T1. This is indicated at time T10 and T11.

Substantial false alarm protection is built into the above described circuit. This includes circuit 55 which filters any narrow (e.g. microsecond width) low voltage spikes from the output of amplifier 43. These spikes could be generated for example by a radiated noise burst such as from a car ignition or drill which is picked up by antenna 14 and somehow passed through all of the previously described false alarm protection circuitry. Circuit 55 preferably has a RC time constant of approximately 50 milliseconds.

Similarly, feedback diode 56 prevents circuit malfunction. Specifically, diode 56 clamps input 43*a* to a low voltage when circuit 50 is timing out. This prevents retriggers during time out. That is, so long as signals S54 is high enough to force the output of gate 54 low, then that low is fed back to input 43*a*. As a result, signal S43 is forced high, and will remain forced high until circuit 50 times out. Thus, once circuit 50 is triggered, it cannot be retriggered until circuit 50 times out. Without diode 56, such retriggering might possibly occur for example, due to ripple on the +V source which is induced by relatively high power switching that occurs in alarm circuit 60 when it is activated during time out.

In addition, feedback circuit 57 prevents circuit malfunction. This circuit consists of a serially connected resistor-diode combination. The purpose of circuit 57 is to clamp input 33*a* of amplifier 33 high during time out. This in turn prevents current I from switching from a positive direction to a negative direction during time out, which prevents circuit 50 from being retriggered until the time out is completed.

Signal S52 is coupled to the input of tone oscillator 60. Oscillator 60 is comprised of two logical NAND gates 62 and 63, which are serially connected to each other. An RC circuit 64 couples the output of NAND gates 62 and 63 back to an input of NAND gate 62. Circuit 60 also includes a transistor 65. The output of NAND gate 63 is coupled through a resistor 66 to the base of transistor 65. Lead 61 couples to the collector of transistor 65, and signals S61 for driving speaker 70 are generated thereon. In operation, prior to time T5, signal S52 is at a low logic level and thus the output of gate 62 is at a logical high. This high is fed back to NAND gate 62 through the resistor of circuit 64. Subsequently, signal S52 goes to a high logic level, and thus NAND gate 62 has two logical highs on its inputs. In response, the output of gate 62 goes low, and RC circuit 64 slowly discharges The resistance-capacitance values of circuit 64 are chosen to have a discharge time of approximately 0.6 milliseconds. After circuit 64 discharges, the low input to gate 62 forces the output of gate 62 high. In response thereto, circuit 64 slowly begins to recharge. This charging and discharging sequence continues until the signal S52 returns to a logical low state at time T10. Signals S52, S54, and S61 are all illustrated in FIG. 4.

Figure 5:
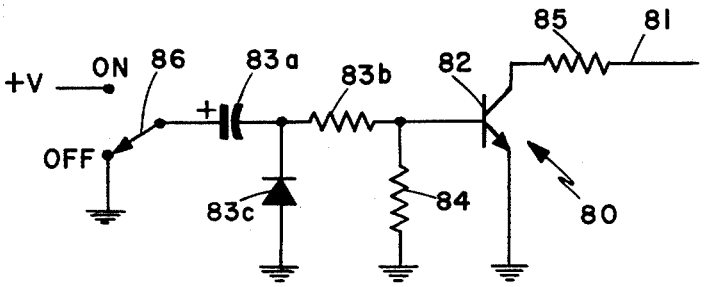
FIG. 5 is a detailed circuit diagram of the remaining blocks of FIG. 2.

Referring now to FIG. 5, the circuitry and operation test circuit 80 will be described. Circuit 80 includes a transistor 82 having a collector coupled to lead 81, and an emitter coupled to ground. The base of transistor 82 couples to switch 86 through a resistor-capacitor-diode circuit 83, and to ground through a resistor 84. In operation, when switch 86 is turned from an off position to an on position, the voltage on both sides of capacitor within circuit 83 is charged to the supply voltage +V. Immediately thereafter, capacitor 83*a* begins to discharge through resistors 83*b* and 84. The RC discharge time constant of this circuit is set for approximately 15 seconds. During the time capacitor 83*a* discharges, transistor 82 is turned on. As a result, transistor 82 couples a resistor 85 in parallel with the resistor of tone timer circuit 53. This parallel combination changes the RC discharge time of circuit 53 to approximately one second. Thus, for the period of time during which capacitor 83*a* discharges, (e.g. approximately 15 seconds) circuit 50 has a discharge time of approximately one second, and thus circuit 60 is enabled for a period of only approximately one second to generate audio frequency signals. It is during this 15 second interval that the operator of the disclosed alarm device is able to place the device on a door knob, to close and lock the door, and to test the device by placing his hand close to it. The operator must then move away from the device before the 15 second interval is over.

Various specific embodiments of the invention have now been described in detail. Based on these teachings, it will be apparent to those with skill in the art that many modifications may be made to the disclosed details without departing from the nature and spirit of the invention. For example, circuits may be included to take action other than the sounding of an audible alarm upon the detection of an object intruding into the detection zone. Suitably, a silent alarm may be sent to the local police station. Further, device 10 may be utilized to detect vandals who intrude through doors without door knobs or through windows. In either case, device 10 is simply laid adjacent to the door or window that is to be secured, such that the door or window lies within the devices detection zone. In operation, when the door or window is moved by an intruder, a change in capacitive coupling with antenna 14 will occur. This change will be detected by the disclosed electronics and the alarm will be sounded in response thereto. Accordingly, since many changes can be made to the disclosed details without departing from the nature and spirit of the invention, it is to be understood that the invention is not to be limited to said details, but that the scope of the invention is to be defined by the appended claims.

Having described our invention, we now claim:

1. A portable electronic device for detecting the presence of absence of objects, said device being comprised of first circuit means for capacitively coupling to any objects within a zone surrounding said first circuit, second circuit means connected to said first circuit means for generating output signals indicating changes in said capacitive coupling, and third circuit means connected to said second circuit means for receiving said output signals and for taking predetermined action when said output signals indicate an intrusion of objects into or movement of objects within said zone, wherein said first circuit means is an antenna comprised of a wire in the shape of a loop for placement onto a doorknob and wherein said wire is covered with an insulator such that said antenna capacitively couples to said doorknob without being in physical contact therewith.

2. A device according to claim 1 wherein said wire and insulator are flexible and said antenna further includes a slip-ring around said antenna for increasing and decreasing the size of said loop to rigidly connect said device to said doorknob.

3. A device according to claim 1 wherein said second circuit means includes variable frequency oscillator means for generating oscillating signals having frequencies indicating the amount of said coupling, and filter means connected thereto for rejecting capacitive coupling changes between said antenna and objects within said zone which occur at above human movement rates.

4. A device according to claim 3 wherein said second circuit means further includes means for converting said oscillating signals to analog voltage levels representative of the frequency of oscillation coupled to said variable frequency oscillator, and means for generating said output signals in the form of logic levels in response to predetermined changes in the level of said analog voltage levels.

5. A device according to claim 4 wherein said means for generating includes means for rejecting said analog voltage changes when they occur at less than a predetermined rate.

6. A device according to claim 4, wherein said third circuit means includes feedback means for disabling said means for converting while said predetermined action is occurring.

7. A device according to claim 4, wherein said third circuit means includes feedback means for disabling said means for generating while said predetermined action is occurring.

8. A portable electronic device for detecting the presence or absence of objects, said device being comprised of first circuit means for capacitively coupling to any objects within a zone surrounding said first circuit, second circuit means connected to said first circuit means for generating output signals indicating changes in said capacitive coupling, third circuit means connected to said second circuit means for receiving said output signals and for sounding an alarm for a predetermined time interval when said output signals indicate an intrusion of objects into and movement of objects within said zone, and fourth circuit means connected to said third circuit means for temporarily shortening said time interval in response to a manually activated switch.

9. A device according to claim 8 wherein said first circuit means is an antenna comprised of a wire in the shape of a loop for placement onto a doorknob and wherein said wire is covered with an insulator such that said antenna capacitively couples to said doorknob without being in physical contact therewith.

10. A device according to claim 8 wherein said second circuit means includes variable frequency oscillator means for generating oscillating signals having frequencies indicating the amount of said coupling, and filter means connected thereto for rejecting capacitive coupling changes between said first circuit means and objects within said zone which occur at above human movement rates.

11. A device according to claim 8 wherein said second circuit means further includes means for converting said oscillating signals to analog voltage levels representative of the frequency of oscillation coupled to said variable frequency oscillator, and means for generating said output signals in the form of logic levels in response to predetermined changes in the level of said analog voltage levels.

12. A device according to claim 11 wherein said means for generating includes means for rejecting said analog voltage changes when they occur at less than a predetermined rate.

13. A device according to claim 11 wherein said third circuit means includes means for rejecting said analog voltage changes when they occur at less than a predetermined rate.

14. A device according to claim 11, wherein said third circuit means includes feedback means for disabling said means for generating while said alarm is sounding.

* * * * *